US007041071B2

(12) United States Patent
Kang

(10) Patent No.: US 7,041,071 B2
(45) Date of Patent: May 9, 2006

(54) METHOD AND APPARATUS FOR ADJUSTING LUMBOSACRAL AREA

(76) Inventor: Sang Wook Kang, 442 Kuzora-ri, Ilun-myeon, Geoje-shi, Kyeongsangnam-do (KR)

( * ) Notice: Subject to any disclaimer, the term of this patent is extended or adjusted under 35 U.S.C. 154(b) by 572 days.

(21) Appl. No.: 10/386,863

(22) Filed: Mar. 12, 2003

(65) Prior Publication Data

US 2004/0181258 A1 Sep. 16, 2004

(51) Int. Cl.
*A61H 1/00* (2006.01)

(52) U.S. Cl. ..... 601/98; 601/101; 601/134; 601/136; 606/240; 606/242

(58) Field of Classification Search ..... 601/84, 601/86, 18, 90, 97, 98, 101, 103, 116, 117, 601/107, 108, 111, 134; 606/240–242; 5/611–613, 5/943

See application file for complete search history.

(56) References Cited

U.S. PATENT DOCUMENTS 2,714,381 A * 8/1955 Corley et al. ..... 601/134
3,403,674 A * 10/1968 Constantin ..... 601/134
4,041,938 A * 8/1977 Wintoniw ..... 601/101
4,875,470 A * 10/1989 Cotone ..... 601/117
4,984,568 A * 1/1991 Persaud ..... 601/122
5,022,386 A * 6/1991 Kuniskis ..... 601/117
5,545,177 A * 8/1996 Coseo ..... 606/204
5,582,582 A * 12/1996 Chapman ..... 601/112
5,916,182 A * 6/1999 Fengler ..... 601/110
6,375,631 B1 * 4/2002 Harris et al. ..... 601/98
6,685,659 B1 * 2/2004 Webb ..... 601/49

FOREIGN PATENT DOCUMENTS

GB A 2166351 * 5/1986
JP 406098914 A * 4/1994

* cited by examiner

*Primary Examiner*—Danton D. DeMille
*Assistant Examiner*—Manuj Agarwal
(74) *Attorney, Agent, or Firm*—Anderson Kill & Olick, PC

(57) ABSTRACT

Disclosed is a method and apparatus for adjusting lumbosacral area, which corrects misalignment of the vertebrae in the lumbosacral area by applying pressure on the lumbosacral area. The present invention simultaneously applies vertical and horizontal forces to the lumbosacral area where vertebral displacement has occurred to adjust the vertebral displacement in the lumbosacral area and remove stress concentrated on the lumbosacral area. Accordingly, the lumbosacral area where the vertebral displacement has happened can be easily adjusted. Also, when the apparatus is manually operated, there is an effect that muscular strength can be increased while adjusting the lumbosacral area. In addition, stress concentrated on a lumbosacral joint wherein the lumbar vertebrae and the sacral vertebrae meet together is removed, so that a user can enjoy physically and mentally healthy life.

6 Claims, 8 Drawing Sheets

METHOD AND APPARATUS FOR ADJUSTING LUMBOSACRAL AREA

BACKGROUND OF THE INVENTION

1. Field of the Invention

The present invention relates to a method and apparatus for adjusting lumbosacral area, and more particularly, to a method and apparatus for adjusting lumbosacral area, which corrects misalignment of the vertebrae in the lumbosacral area by applying pressure on the lumbosacral area. To be specific, the present invention relieves pressure on nerves between the fifth lumbar vertebra (hucklebone) and the first sacral vertebra (pelvic bone), thereby enabling users, whether or not they surfer from vertebral displacement to alleviate nerve compression between the lumbar vertebrae and the sacral vertebrae in the lumbosacral area.

2. Background of the Related Art

In general, the spinal column which is one of the most important parts in the human body is a central bone structure. Therefore, the importance of the vertebrae has been well known and emphasized. An exemplary view of the spinal column is shown in FIG. 8.

FIG. 8 is a schematic view illustrating the configuration of the spinal column in the human body.

Referring to FIG. 8, the spinal column consists of a series of 33 irregularly shaped bones, which are called vertebrae. The vertebrae are bilaterally symmetrical as a whole and look gently curved when being seen from a side. That is to say, cervical area 1 and lumbar area 3 are curved forward and thoracic area 2 and sacral area 4 are curved backward. Reference numeral 5 designates coccygeal area.

The important function of the spinal column is divided into two categories. One is to support the head and torso and allow the body parts to move. The other is to provide a protective channel for nerves, which project from the brain to each part of the human body.

Spinal nerves exit the spinal canal between the vertebrae. The spinal nerves are made up of neurons which are widely distributed within all organs, muscles, blood vessels, ligaments, and skin of the human body. The spinal column and the spinal nerves control all physical functions, such as feeling, movement, position sense, regulation of body temperature, regulation of heart rate, regulation of respiration, regulation of blood glucose, etc. Such nerve systems control every activity done both voluntarily and involuntarily. Therefore, it is of paramount importance in health that the vertebrae for protecting the spinal cord, i.e., the bundle of nerves, are in their correct positions.

That is to say, when the vertebrae are in the correct positions, the spinal cord or the spinal nerves function well without any difficulty whereas when the vertebrae are displaced, the spinal nerves exiting the spinal canal between the vertebrae begin to be compressed, thereby causing troubles in many nerve systems. The troubles in the nerve system undermine functions of human organs concerned and immune systems as well, leading to a serious disease.

Since a human being walks on two legs, differently from animals which walk on four limbs, he or she suffers an excessive force applied to the waist, especially to a contact point between the lumbar vertebrae (hucklebone) and the sacral vertebrae (pelvic bone), such that he or she is susceptible to vertebral displacement. This is because the sacral vertebrae are curved forward, abnormal stress is applied on him or her due to gravity generated by the large lordosis angle of the sacral vertebrae. Besides, since the lumbar vertebrae are moved in a wide range while the sacral vertebrae are fixed, the lumbosacral vertebrae, pertaining to the lumbar vertebrae and the sacral vertebrae, are susceptible to damage when he or she bends his or her back forward or backward.

Therefore, the misalignment of the vertebrae in the lumbosacral area should be corrected by widening the space between the sacral vertebrae and the lumbar vertebrae to remove the stress applied to the lumbosacral area 6. Even persons who don't suffer from a lumbago can enjoy vibrant metabolism and better life physically and mentally through the process of removing the stress applied to the lumbosacral area 6.

In general, a vertebrae deformity adjusting apparatus used in physical therapy rooms of hospitals or the like is structured such that it repeatedly pulls a patient's body in a longitudinal direction for a predetermined time using an elastic force of a spring or a mechanical force to relax the vertebrae and then stops the application of the pulling force to return the patient's body to its original state, thereby guiding the vertebrae into their correct positions. However, since the vertebrae deformity adjusting apparatus functions to only extend the human body, it has a limitation in vertebral misalignment correction.

A more developed type of apparatus than the above vertebrae deformity adjusting apparatus is disclosed in Korean Utility Model Registration No. 93-4383 (registered on Jul. 14, 1993). In a state where a patient's body is pulled in a longitudinal direction, the lower half of the body is shaken to guide the vertebrae to their correct positions. The apparatus, however, has a drawback in that since the lower half of the body is simply shaken while the body is extended, to stop the application of the pulling force is not of considerable help in correcting the deformity of the vertebrae.

Besides, Korean Utility Model Publication No. 99-5079 (published on Feb. 5, 1999) discloses an apparatus which adjusts the vertebrae by instantly applying a pressure to the vertebrae. The apparatus of Korean Utility Model Publication No. 99-5079 is superior in adjustment effect to the aforesaid apparatuses which simply extend or shake the patient's body. The apparatus of Korean Utility Model Publication No. 99-5079, however, has a disadvantage in that it can be applied only to a case where the degree of misalignment is not serious and it is not so useful to correct vertebral misalignment in the lumbosacral joint region. The apparatus has another disadvantage in that it cannot basically solve stress concentration on the lumbosacral joint region where the lumbar vertebrae and the sacral vertebrae meet together.

SUMMARY OF THE INVENTION

Accordingly, the present invention has been made in view of the above problems, and it is an object of the present invention to provide a method and apparatus for adjusting lumbosacral area that corrects severe displacement of the vertebrae, especially, the vertebrae in a lumbosacral joint where the fifth lumbar vertebra and the first sacral vertebra meet together.

Another object of the present invention is to provide a method and apparatus for adjusting lumbosacral area that solves a concentration problem of stress applied on a lumbosacral joint where the lumbar vertebrae and the sacral vertebrae meet together.

To achieve these objects in an aspect of the present invention, there is provided an apparatus for adjusting lumbosacral area, comprising: a post-shaped contact member contacting the lumbosacral area and including an inclined surface formed at one end thereof; a vertical force applying member adapted to apply load to the lumbosacral area, and including a case which is open on the upper portion thereof for allowing weighty articles to be put therein to control the weight of the vertical force applying member, and a contact member attaching/detaching unit disposed on the lower end of the case for attaching or detaching the contact member to or from the case; a horizontal force applying member for moving the contact member in a longitudinal direction of a patient to apply a horizontal force to the lumbosacral area of the patient; a lifting member for lifting the contact member and the vertical force applying member to secure a space required for the patient to lie down below the contact member; a frame adapted to allow the contact member, the vertical force applying member, the horizontal force applying member and the lifting member to be mounted thereon, and including a safety plate located under the contact member and the vertical force applying member for preventing the contact member and the vertical force applying member from falling to the patient; and a bed disposed beneath the frame for allowing the patient to lie thereon to be treated.

The horizontal force applying member includes: two rails laid on the bed in a longitudinal direction of the bed in such a manner that the two rails are spaced apart from each other by a lateral extent of the frame; a plurality of wheels mounted to the lower ends of the frame for helping the frame to be moved along the rails laid on the bed in forward and rearward directions; a movable handle located on the front portion of the bed; a wire connected to the movable handle at one end thereof and connected to the rear side of the frame to which the wheels are mounted at the other end thereof in such a manner that the wire is passed through the bottom surface of the bed for moving the frame along the rails laid on the bed in the rearward direction when the movable handle is pulled toward the patient's body; and a plurality of rollers for helping the wire to be moved smoothly.

The horizontal force applying member includes: two rails laid on the bed in a longitudinal direction of the bed in such a manner that the two rails are spaced from each other by a lateral extent of the frame; a plurality of wheels mounted to the lower ends of the frame for helping the frame to be moved along the rails laid on the bed in forward and rearward directions; an electric motor for pulling the frame to which the wheels are mounted to move the same in the rearward direction; an electric motor controller electrically connected to the electric motor for driving the electric motor in a state where the patient lies on the bed; a wire connected to the rear side of the frame at one end thereof and connected to the electric motor at the other end thereof for moving the frame along the rails laid on the bed in the rearward direction; and a plurality of rollers for helping the wire to be moved smoothly.

The horizontal force applying member includes: a frame fixing unit for fixing the frame to the bed; and a fixed handle mounted on the front portion of the bed such that the patent holds the fixed handle and pulls his or her body lying on the bed in the forward direction with arm strength to apply a horizontal force to the lumbosacral area due to interaction between the lumbosacral area and the contact member.

To achieve those objectives in another aspect of the present invention, there is provided a method for adjusting lumbosacral area comprising the steps of: positioning the inclined surface of the contact member of claim 1 to conform to the contour of the lumbosacral area in which vertebral displacement has occurred; applying a vertical force to the lumbosacral area; and applying a horizontal force to the lumbosacral area by moving the contact member toward the hips of the patient while applying the vertical force.

The horizontal force applying step is carried out manually or by means of an electric motor.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
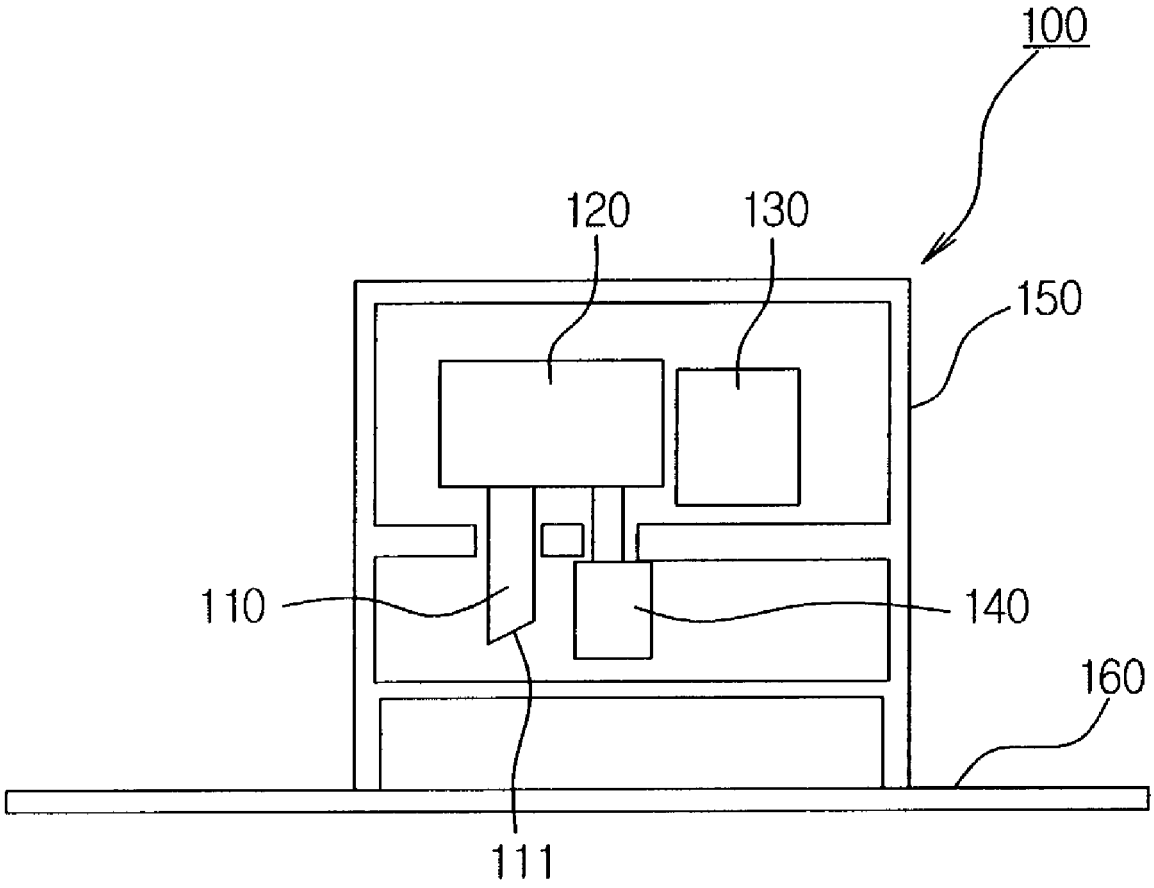
FIG. 1 is a schematic view of an apparatus for adjusting lumbosacral area according to a first preferred embodiment of the present invention.
Figure 2:
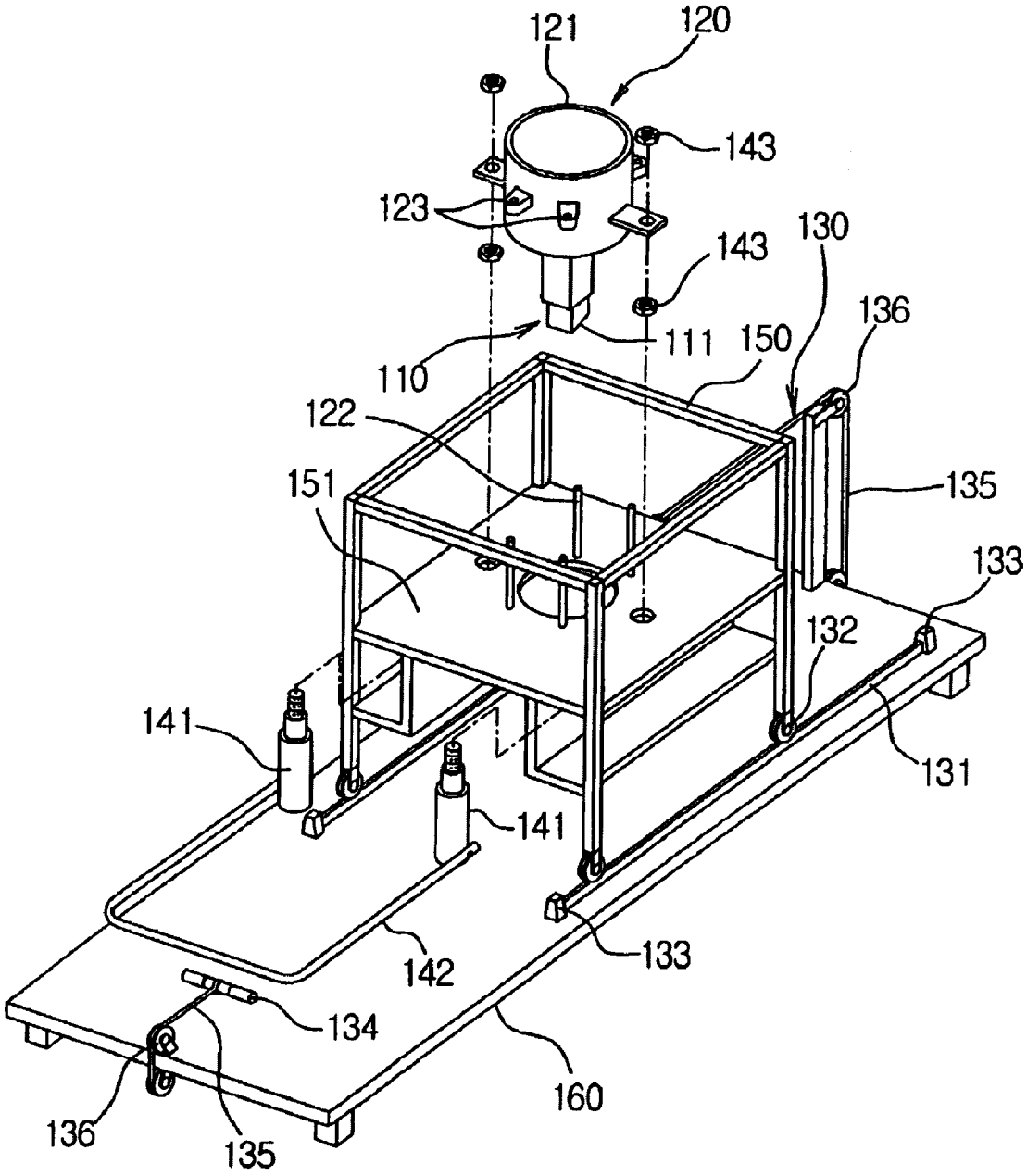
FIG. 2 is an exploded perspective view of the lumbosacral area adjusting apparatus according to the first preferred embodiment of the present invention.
Figure 3:
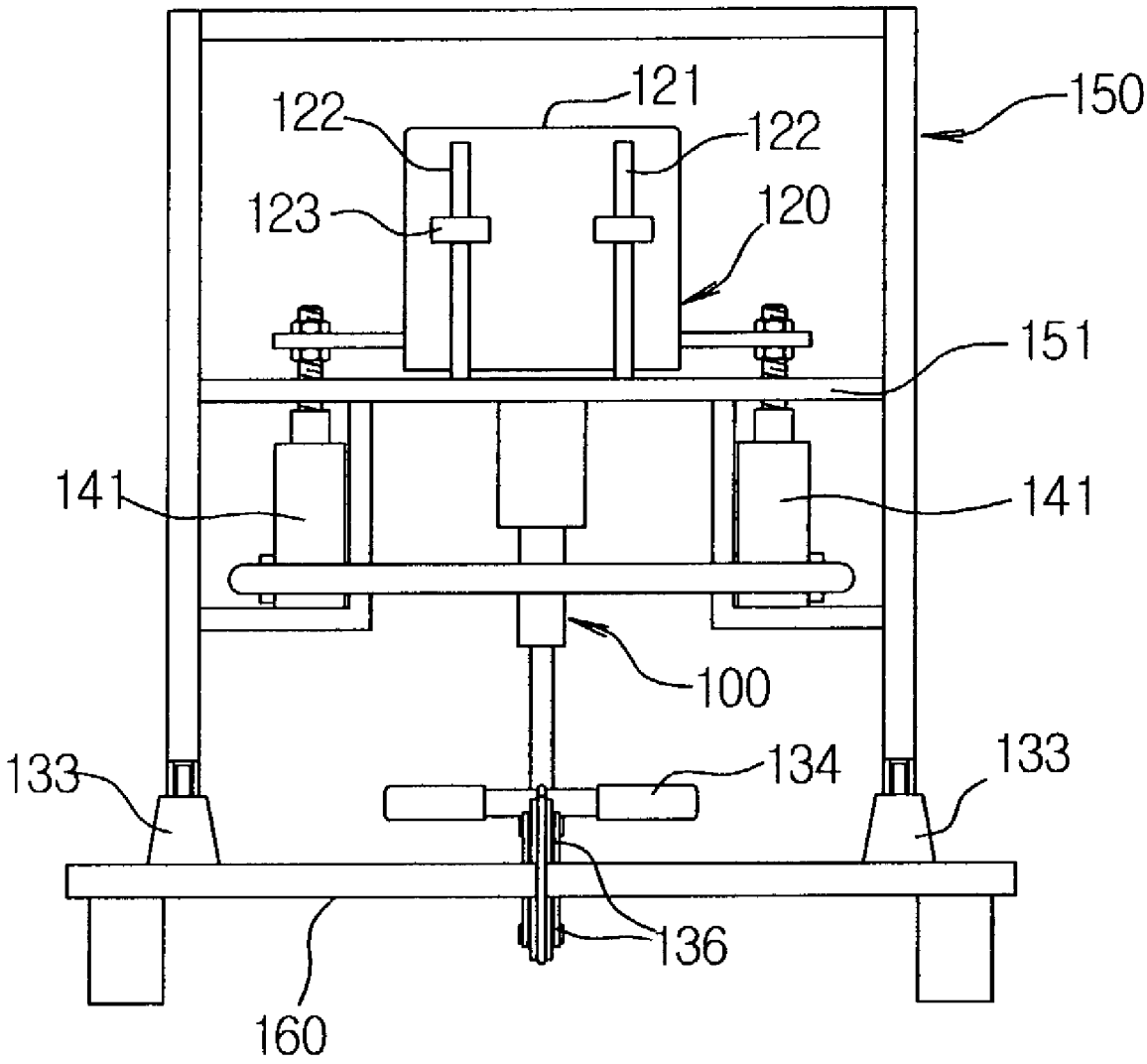
FIG. 3 is a front view of the lumbosacral area adjusting apparatus of FIG. 2.
Figure 4:
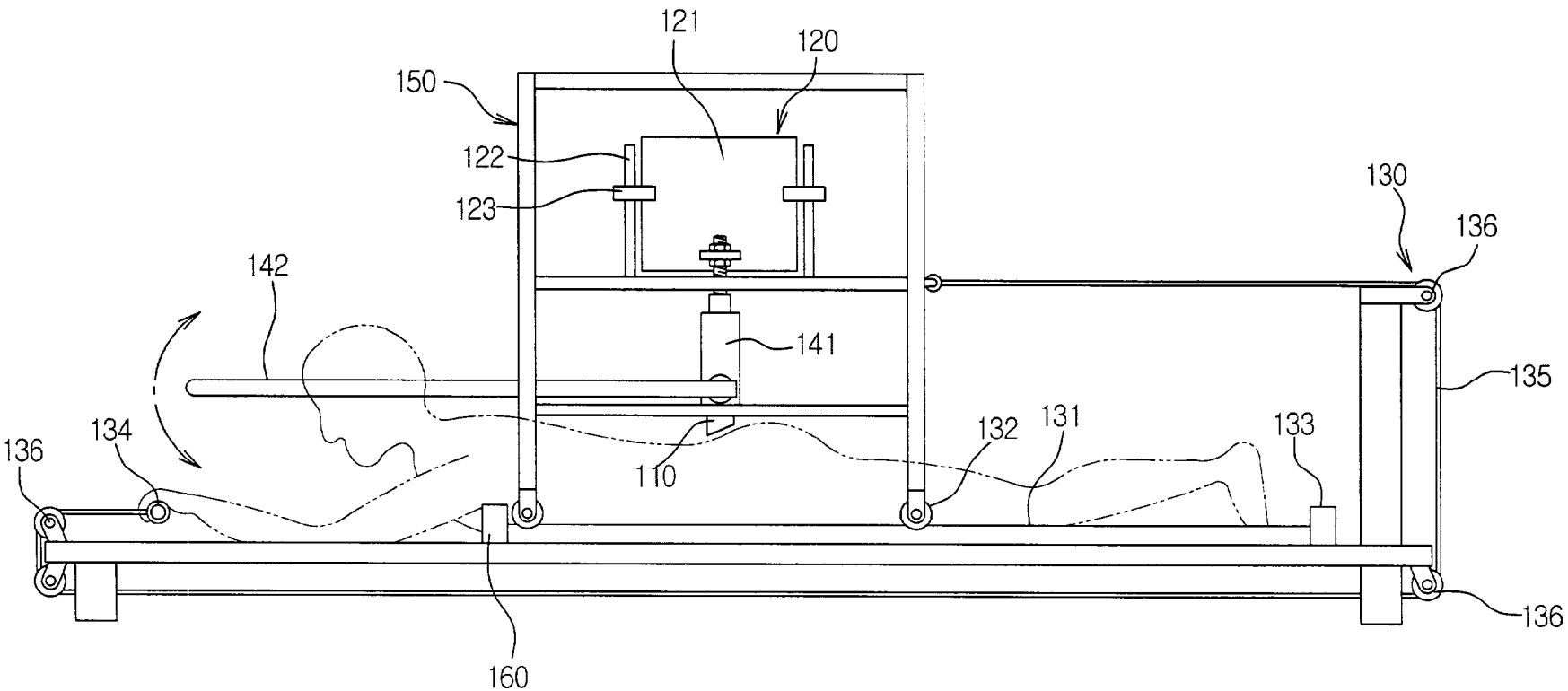
FIG. 4 is a side view of the lumbosacral area adjusting apparatus of FIG. 2.

FIG. 1 is a schematic view of an apparatus for adjusting lumbosacral area according to a first preferred embodiment of the present invention, FIG. 2 is an exploded perspective view of the lumbosacral area adjusting apparatus according to the first preferred embodiment of the present invention, FIG. 3 is a front view of the lumbosacral area adjusting apparatus of FIG. 2, and FIG. 4 is a side view of the lumbosacral area adjusting apparatus of FIG. 2.

Referring to FIGS. 1 through 4, an apparatus 100 for adjusting lumbosacral area according to the first preferred embodiment of the present invention includes a rectangular post-shaped contact member 110 contacting the lumbosacral area and including an inclined surface 111 formed at one end thereof; a vertical force applying member 120 adapted to apply load to the lumbosacral area, and including a case 121 which is open on the upper portion thereof for allowing weighty articles to be put therein to control the weight thereof, and a contact member attaching/detaching unit disposed on the lower end of the case 121 for attaching or detaching the contact member 110 to or from the case 121; a horizontal force applying member 130 for moving the contact member 110 in a longitudinal direction of a patient to apply a horizontal force to the lumbosacral area of the patient; a lifting member 140 for lifting the contact member 110 and the vertical force applying member 120 to secure a space required for the patient to lie down below the contact member 110; a frame 150 adapted to allow the contact member 110, the vertical force applying member 120, the horizontal force applying member 130 and the lifting member 140 to be mounted thereon, and including a safety plate 151 located under the contact member 110 and the vertical force applying member 120 for preventing the contact member 110 and the vertical force applying member 120 from falling to the patient; and a bed 160 disposed beneath the frame 150 for allowing the patient to lie thereon to be treated.

The contact member 110 is a portion in direct contact with the lumbosacral area in which vertebral displacement has occurred due to biped walking of the patient. The contact member 110 is of a rectangular post shape having the inclined surface 111 formed at the one end thereof.

The inclined surface may be a flat surface or a curved surface. Further, the inclination of the inclined surface is variable according to the degree of displacement. Also, the contact member 110 is structured to be attachable to or detachable from the vertical force applying member 120, so that the vertebral displacement adjustment is carried out using a contact member with optimal inclination in consideration of the degree of displacement. That is to say, a contact member with a steep slope is used in case of severe vertebral displacement whereas a contact member with a gentle slope is used in case of slight vertebral displacement.

The vertical force applying member 120 includes the case 121 which is open on the upper portion thereof. The vertical force applying member 120 applies a vertical force to the lumbosacral area using the weight of the weighty articles put in the case. For example, a user can adjust the weight of the vertical force applying member 120 by putting articles, such as various metals, stones or the like, in the case. Thus, the weight of the vertical force applying member 120 can be adjusted according to the user's age, condition of health and the degree of vertebral displacement.

The vertical force applying member 120 is lifted by the lifting member 140 which will be described in detail below and lowered due to self-weight and gravity. At this time, to ensure smooth motion and linearity of the vertical force applying member 120, four guide bars 122 are disposed around the vertical force applying member 120 and sliding holes 133 are mounted on the outer peripheral surface of the vertical force applying member 120 for sliding along the guide bars 122 (see FIG. 2).

As shown in FIG. 2, the lifting member 140 includes hydraulic cylinders 141 which are manually operated and have pumps embedded therein, a grip 142 for driving the hydraulic cylinders 141, a relief valve switch (not shown in FIG. 2), and coupling units 143 for coupling the ends of the cylinders 141 to the vertical force applying member 120.

When the grip 142 is moved upwardly and downwardly, rods of the hydraulic cylinders 141 are upwardly moved and at the same time, the contact member 110 mounted to the vertical force applying member 120 is upwardly moved. Accordingly, a space is formed between the contact member 110 and the bed 160 so that a person who wants to adjust his or her lumbosacral area can get into and out of the lumbosacral area adjusting apparatus. At this time, the grip 142 is located at a position where the patient can hold up his or her hands and grasp the same after lying on the bed 160, so that the user can manipulate the grip without other's help.

After the contact member 110 is sufficiently lifted, as shown in FIG. 4, the patient lies on the bed 160 and operates the relief valve to adjust the height of the contact member 110 mechanically connected to the hydraulic cylinders 141 until the contact member 110 is located at a position in which a proper amount of pressure is applied to the lumbosacral area.

Thereafter, the contact member 110 is moved toward the hips of the patient by means of the horizontal force applying member 130. The horizontal force applying member 130 includes: two rails 131 laid on the bed 160 in a longitudinal direction of the bed 160 in such a manner that the two rails 131 are spaced apart from each other by a lateral extent of the frame 150; a plurality of wheels 132 mounted to the lower ends of the frame 150 for helping the frame 150 to be moved along the rails 131 laid on the bed 160 in forward and rearward directions; deviation preventing jaws 133 for preventing deviation of the wheels 132; a movable handle 134 located on the front portion of the bed 160; a wire 135 connected to the movable handle 134 at one end thereof and connected to the rear side of the frame 150 to which the wheels 132 are mounted at the other end thereof in such a manner that the wire 135 is passed through the bottom surface of the bed 160 for moving the frame 150 along the rails 131 laid on the bed 160 in the rearward direction when the movable handle 134 is pulled toward the patient's body; and a plurality of rollers 136 for helping the wire 135 to be moved smoothly (see FIG. 4).

Therefore, when the patient pulls the movable handle 134 toward his or her body while he or she lies on the bed 160, the frame 150 connected to the wire 135 is moved toward the hips of the body such that the contact member 110 applies a horizontal force to the lumbosacral area of the patient, leading to adjustment of the lumbosacral area in which the vertebral displacement has occurred.

Figure 5:
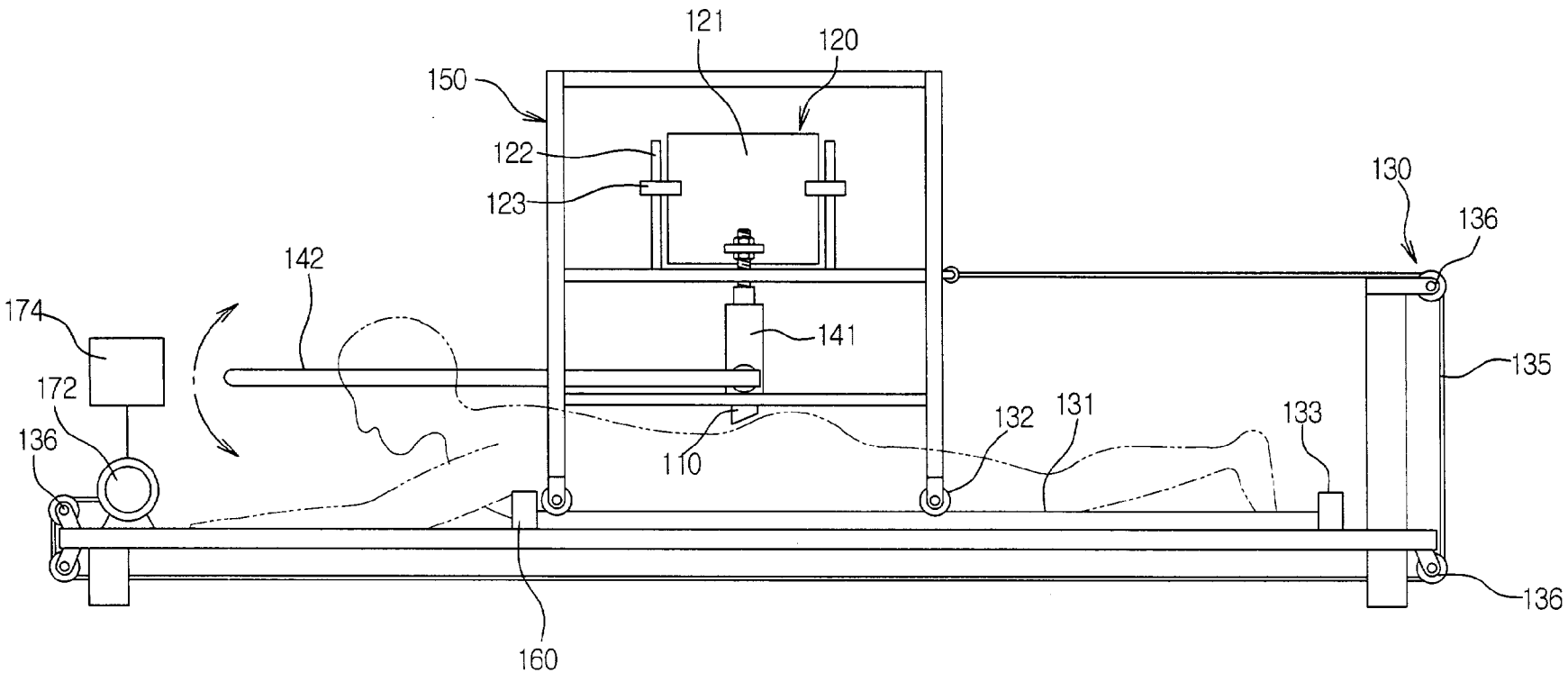
FIG. 5 is a side view of an apparatus for adjusting lumbosacral area according to a second preferred embodiment of the present invention.

FIG. 5 is a side view of an apparatus for adjusting lumbosacral area according to a second preferred embodiment of the present invention.

In the first preferred embodiment, the patient who desires to adjust his or her lumbosacral area operates the horizontal force applying member 130 personally. Differently from the first preferred embodiment, in the second preferred embodiment, the horizontal force applying member 130 is operated by means of a power unit, such as an electric motor. The same parts shown the first and second preferred embodiments will have the same reference numerals in order to avoid redundancy.

The horizontal force applying member 130 includes: two rails 131 laid on the bed 160 in a longitudinal direction of the bed 160 in such a manner that the two rails 131 are spaced from each other by a lateral extent of the frame 150; a plurality of wheels 132 mounted to the lower ends of the frame 150 for helping the frame 150 to be moved along the rails 131 laid on the bed 160 in forward and rearward directions; an electric motor 172 for pulling the frame 150 to which the wheels 132 are mounted to move the same on the bed 160 in the rearward direction; an electric motor controller 174 electrically connected to the electric motor 172 for driving the electric motor 172 in a state where the patient lies on the bed 160; a wire 135 connected to the rear side of the frame 150 at one end thereof and connected to the electric motor 172 at the other end thereof for moving the frame 150 along the rails 131 laid on the bed 160 in the rearward direction; and a plurality of rollers 131 for helping the wire 135 to be moved smoothly.

That is, in the second preferred embodiment, when the patient operates only the electric motor controller 174, the wire 135 can be pulled with the help of the electric motor 172, differently form the first preferred embodiment where the patient directly pulls the wire 135. In this case, since the wire 135 can be pulled by means of the electric motor 172, the lumbosacral area adjusting apparatus according to the second preferred embodiment is convenient to use. A series of steps for driving the electric motor 172 by means of the electric motor controller 174 are based on common technology, and therefore, explanation of the steps will be omitted.

Figure 6:
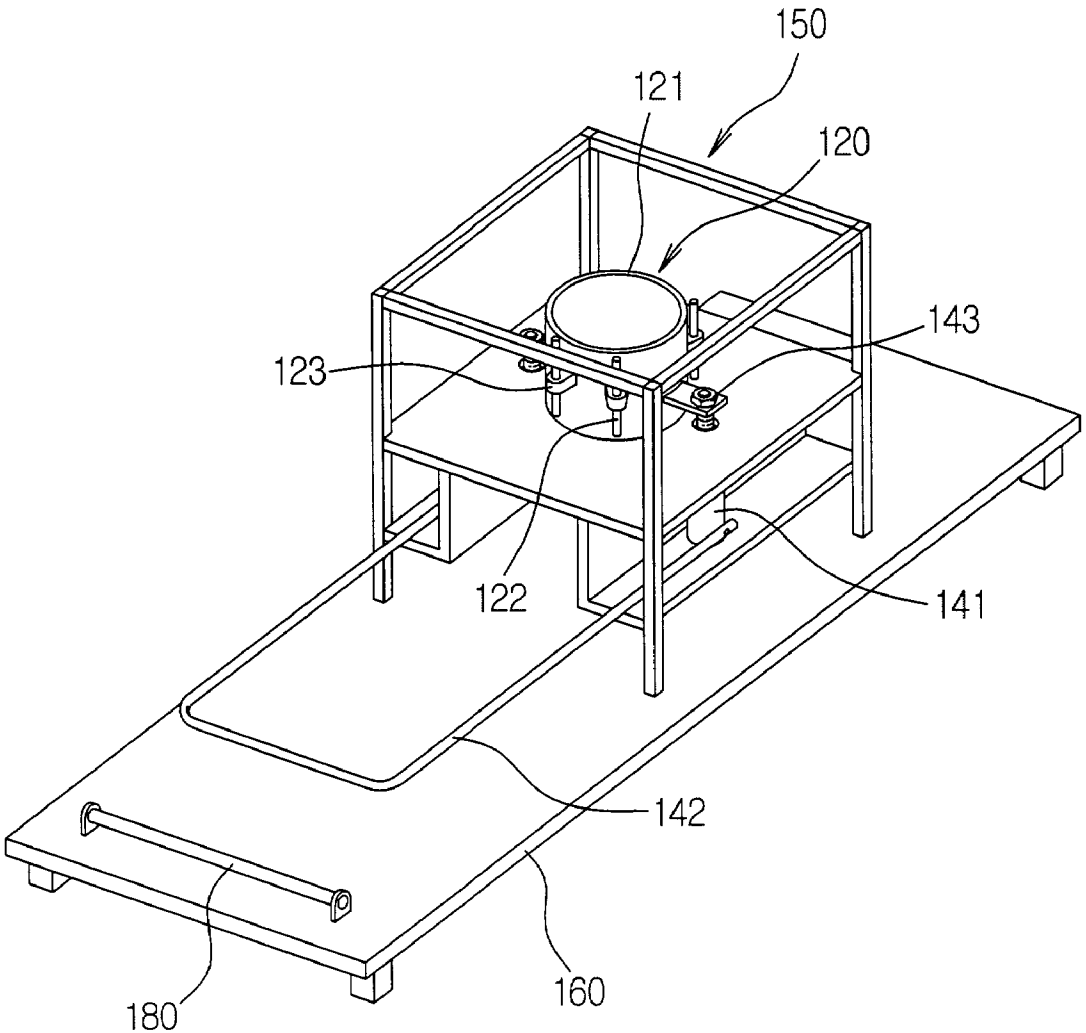
FIG. 6 is a perspective view of an apparatus for adjusting lumbosacral area according to a third preferred embodiment of the present invention.
Figure 7:
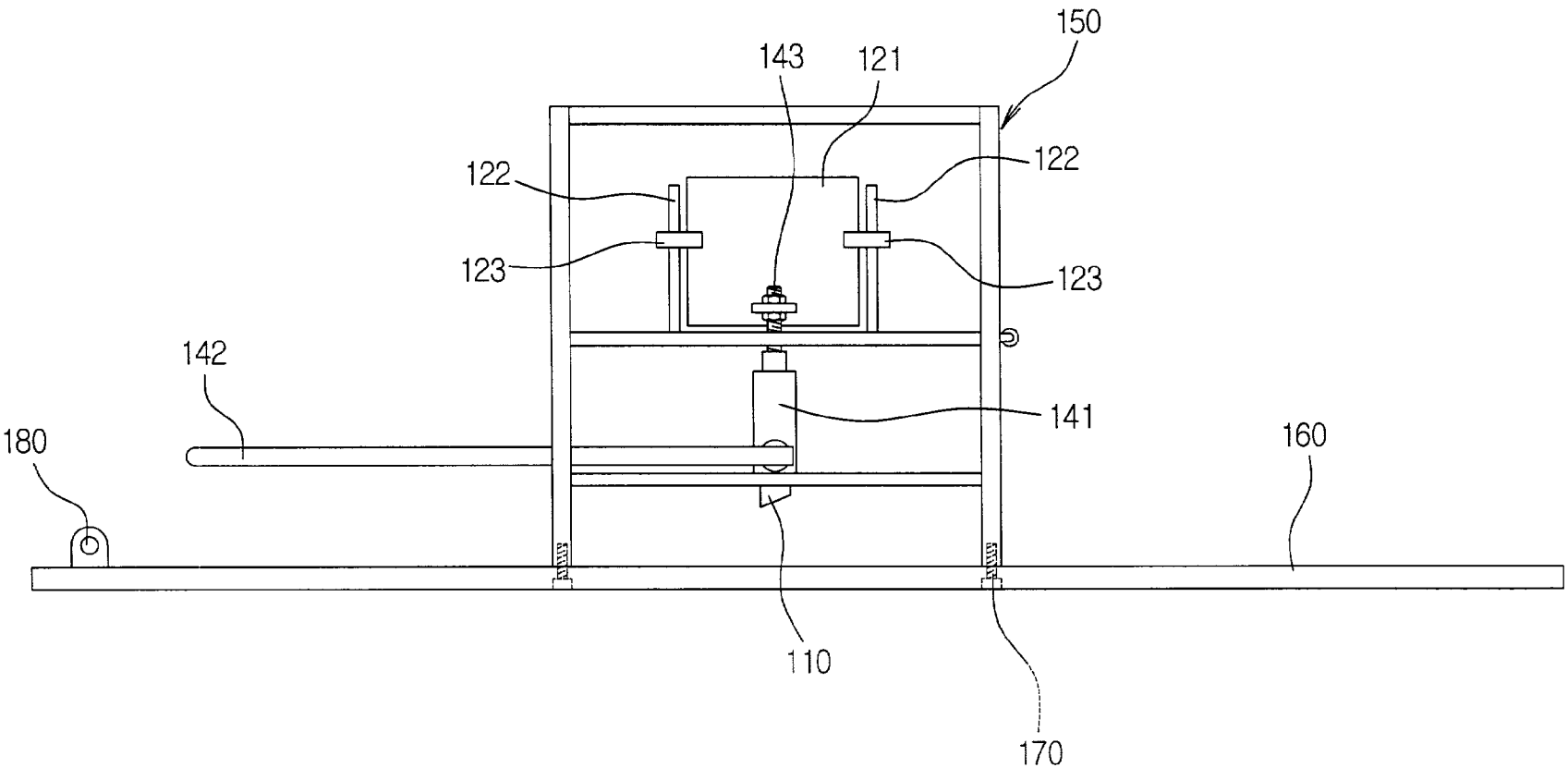
FIG. 7 is a side view of the lumbosacral area adjusting apparatus of FIG. 6.

FIG. 6 is a perspective view of an apparatus for adjusting lumbosacral area according to a third preferred embodiment of the present invention. FIG. 7 is a side view of the lumbosacral area adjusting apparatus of FIG. 6.

The same parts shown in the first, second and third preferred embodiments have the same reference numerals in order to avoid redundancy.

Referring to FIGS. 6 and 7, the frame 150 is fixed to the bed 160 by welding or by means of fixing means, such as bolt(170) coupled to the bottom of the bed 160, and a fixed handle 180 is mounted at the front portion of the bed 160.

Figure 8:
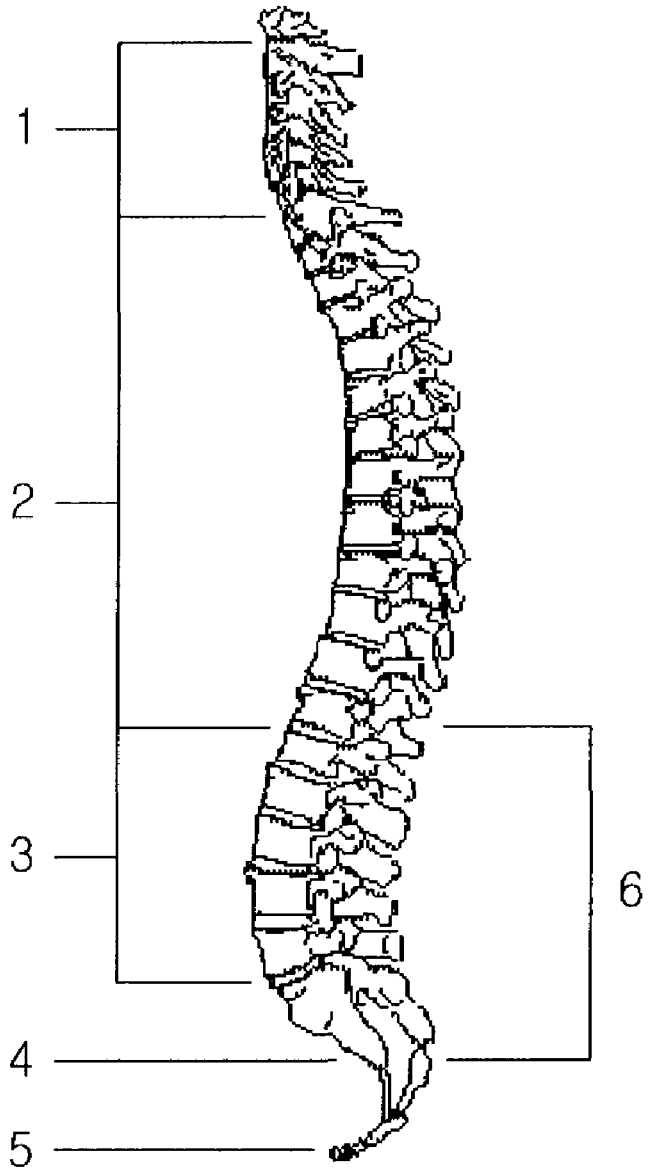
FIG. 8 is a schematic view illustrating the configuration of the spinal column in the human body.

That is, as shown in FIG. 6, the frame 150 is fixed to the bed 160. Accordingly, the contact member 10 and the vertical force applying member 120 mounted on the frame 150 for applying a vertical force to the lumbosacral area (see FIG. 8) can be moved vertically but cannot be moved horizontally and laterally. The horizontal force applying member includes a fixed handle 180 mounted on the front portion of the bed 160 such that the patient makes long arms to grasp the fixed handle and folds his or her arms to move his or her body in the forward direction with his or her arm strength to apply a horizontal force to the lumbosacral area due to action-reaction between the contact member 110 and the lumbosacral area (see FIG. 8). The lumbosacral area adjusting apparatus of the third preferred embodiment is simple in structure.

It goes without saying that there can be used an apparatus which simultaneously applies horizontal and vertical forces to the lumbosacral area by means of a mechanical device, such as a cylinder to correct the displacement of the vertebrae in the lumbosacral area and remove the stress concentrated on the lumbosacral area.

As described above, the apparatus can adjust the lumbosacral area in which the vertebral displacement has occurred using the simple means, thereby easily correcting the vertebral displacement in the lumbosacral area without a separate power source. The lumbosacral area adjusting apparatus can be manually driven, thereby both correcting the displacement and improving the patient's muscular strength. Further, the lumbosacral area adjusting apparatus can be driven by means of the electric motor as well, thereby conveniently adjusting the displaced lumbosacral area. Besides, the lumbosacral area adjusting apparatus can remove the stress concentrated on the lumbosacral area where the lumbar vertebrae and the sacral vertebrae meet together, thereby enabling users, whether or not they suffer from such a painful condition as lumbago due to vertebral displacement in the lumbosacral area, to enjoy physically and mentally healthy life.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for adjusting lumbosacral area, comprising:

a post-shaped contact member contacting the lumbosacral area and including an inclined surface formed at one end thereof;

a vertical force applying member adapted to apply load to the lumbosacral area, and including a case which is open on the upper portion thereof for allowing weighty articles to be put therein to control the weight of the vertical force applying member, and a contact member attaching/detaching unit disposed on the lower end of the case for attaching or detaching the contact member to or from the case;

a horizontal force applying member for moving the contact member in a longitudinal direction of a patient to apply a horizontal force to the lumbosacral area of the patient;

a lifting member for lifting the contact member and the vertical force applying member to secure a space required for the patient to lie down below the contact member;

a frame adapted to allow the contact member, the vertical force applying member, the horizontal force applying member and the lifting member to be mounted thereon, and including a safety plate located under the contact member and the vertical force applying member for preventing the contact member and the vertical force applying member from falling to the patient; and a bed disposed beneath the frame for allowing the patient to lie thereon to be treated.

2. The apparatus according to claim 1, wherein the horizontal force applying member includes:

two rails laid on the bed in a longitudinal direction of the bed in such a manner that the two rails are spaced apart from each other by a lateral extent of the frame;

a plurality of wheels mounted to the lower ends of the frame for helping the frame to be moved along the rails laid on the bed in forward and rearward directions;

a movable handle located on the front portion of the bed;

a wire connected to the movable handle at one end thereof and connected to the rear side of the frame to which the wheels are mounted at the other end thereof in such a manner that the wire is passed through the bottom surface of the bed for moving the frame along the rails laid on the bed in the rearward direction when the movable handle is pulled toward the patient's body; and a plurality of rollers for helping the wire to be moved smoothly.

3. The apparatus according to claim 1, wherein the horizontal force applying member includes:

two rails laid on the bed in a longitudinal direction of the bed in such a manner that the two rails are spaced from each other by a lateral extent of the frame;

a plurality of wheels mounted to the lower ends of the frame for helping the frame to be moved along the rails laid on the bed in forward and rearward directions;

an electric motor for pulling the frame to which the wheels are mounted to move the same in the rearward direction;

an electric motor controller electrically connected to the electric motor for driving the electric motor in a state where the patient lies on the bed;

a wire connected to the rear side of the frame at one end thereof and connected to the electric motor at the other end thereof for moving the frame along the rails laid on the bed in the rearward direction; and a plurality of rollers for helping the wire to be moved smoothly.

4. The apparatus according to claim 1, wherein the horizontal force applying member includes:

a frame fixing unit for fixing the frame to the bed; and a fixed handle mounted on the front portion of the bed such that the patent holds the fixed handle and pulls his or her body lying on the bed in the forward direction with arm strength to apply a horizontal force to the lumbosacral area due to interaction between the lumbosacral area and the contact member.

5. A method for adjusting lumbosacral area comprising the steps of:

Positioning the apparatus of claim 1 to conform to the lumbosacral area in which vertebral displacement has occurred;

applying a vertical force to the lumbosacral area; and applying a horizontal force to the lumbosacral area by moving the contact member toward the hips of the patient while applying the vertical force.

6. The method according to claim 5, wherein the horizontal force applying step is carried out manually or by means of an electric motor.

* * * * *